United States Patent [19]

Brighton

[11] Patent Number: 4,651,524

[45] Date of Patent: Mar. 24, 1987

[54] EXHAUST PROCESSOR

[75] Inventor: John Brighton, Columbus, Ind.

[73] Assignee: Arvin Industries, Inc., Columbus, Ind.

[21] Appl. No.: 685,442

[22] Filed: Dec. 24, 1984

[51] Int. Cl.[4] ..... F01N 3/02

[52] U.S. Cl. ..... 60/274; 55/282; 55/466; 55/DIG. 30; 60/286; 60/303; 60/311

[58] Field of Search ..... 60/274, 286, 303, 311, 60/288; 55/DIG. 10, DIG. 30, 282, 283, 466, 523

[56] References Cited

U.S. PATENT DOCUMENTS

| | | | |
|---|---|---|---|
| 3,775,064 | 11/1973 | Berger et al. | 60/288 |
| 4,167,852 | 9/1979 | Ludecke | 60/296 |
| 4,257,225 | 3/1981 | Crone, Jr. | 60/313 |
| 4,264,344 | 4/1981 | Ludecke et al. | 60/313 |
| 4,283,207 | 8/1981 | Martyniuk | 60/282 |
| 4,299,600 | 11/1981 | Kobashi | 60/213 |
| 4,319,453 | 3/1982 | Mann | 60/309 |
| 4,319,896 | 3/1982 | Sweeney | 60/213 |
| 4,335,574 | 6/1982 | Sato et al. | 60/311 |
| 4,345,431 | 8/1982 | Suzuki | 55/DIG. 30 |
| 4,373,330 | 2/1983 | Stark | 60/311 |
| 4,381,643 | 5/1983 | Stark | 60/303 |
| 4,386,497 | 6/1983 | Takagi et al. | 60/296 |
| 4,404,796 | 9/1983 | Wade | 60/274 |
| 4,404,798 | 9/1983 | Takagi et al. | 60/296 |
| 4,450,682 | 5/1984 | Sato | 60/286 |
| 4,512,147 | 4/1985 | Wong | 55/DIG. 30 |

FOREIGN PATENT DOCUMENTS

| | | | |
|---|---|---|---|
| 1001383 | 12/1975 | Canada . | |
| 39915 | 3/1984 | Japan | 60/303 |

*Primary Examiner*—Douglas Hart

*Attorney, Agent, or Firm*—Barnes & Thornburg

[57] ABSTRACT

An exhaust processor having a particulate trap regeneration system is provided. The exhaust processor includes a housing having an inlet for introducing a combustion product containing a contaminate or other particulate matter from an engine and an outlet for exhausting filtered or otherwise treated combustion product from the housing. At least one substrate is situated in the housing from the inlet. The exhaust processor further includes a trap burner for burning particulate matter collected in the substrate. The trap burner is operable to periodically oxidize the trapped particulate matter and thereby regenerate the substrate. The exhaust processor still further includes a bypass system for regulating the flow rate of combustion product introduced into the housing during regeneration of the substrate. The exhaust processor permits combustion product to be introduced into the housing for treatment in the substrate while regeneration of that substrate is actually occurring. The bypass system regulates the flow rate of combustion product that is actually introduced into the housing for treatment in the substrate.

44 Claims, 11 Drawing Figures

130
20
128
186
170
178
180
158
154
172
134
160
164
176
162
166
174
152
142
168
145
146
156
138
136
147
144
140
132
129
18

EXHAUST PROCESSOR

This invention relates to exhaust processors, and particularly to diesel particulate filters and particulate traps to prevent exhaustion of unfiltered exhaust gases. More particularly, this invention relates to an exhaust processor including a trap burner for burning particulate matter collected in the trap and a trap bypass for diverting a portion of the unfiltered exhaust gas away from the trap burner of the trap to prevent premature extinguishment of the burner flame and of the burning particulate matter in the trap itself.

The diesel particulate trap is a relatively new automotive emission technology. A conventional particulate trap filters particulate matter or the like from exhaust gas emitted by a diesel engine and stores the particulate matter in the exhaust gas to clean the exhaust gas. It is necessary to periodically clean the trap to remove the clogging particulate matter that has accumulated therein. Otherwise the trap can become plugged resulting in an undesirably high exhaust system back pressure. This cleaning process is commonly known as "regeneration." It is known to use either hot exhaust gases, an electric charge, or a burner or heater device to oxidize or otherwise incinerate trapped particulate matter to regenerate a diesel particulate trap.

Manufacturers and users of diesel particulate traps will appreciate the hardships and inconveniences generally associated with trap regeneration systems of the type including a burner usable to ignite and oxidize trapped particulate matter. One problem relates to inadequate particle burning. Conventional trap burner systems do not include any means for predictably controlling or influencing the temperature in the trap during or after ignition. Typically, heat generated by a burner flame is unevenly distributed across progressive transverse cross-sections of the trap along its full length. Oftentimes, the burner flame heats the center portion of the trap to a much higher temperature than the peripheral portion of the trap. Thus, heat is unevenly distributed across the inlet end face of the trap at the point where the particulate matter collected in the trap is first ignited. This heat distribution problem causes an uneven oxidation of particulate matter throughout the trap because particulate matter collected in the center of the trap is ignited before matter collected in the periphery thereof. One effect is that the matter collected in the trap does not burn at a constant rate along the length of the trap due to the uneven ignition problem. These undesirable effects cooperate to reduce and undermine the regeneration activity and reduce the efficiency of the particulate trap.

Another problem relates to blow-out of the burner flame during ignition of the trapped particulate matter and to blow out of the particulate matter which continues to burn in the trap itself after ignition. Rapid acceleration of the diesel engine during regeneration of the particulate trap causes the flow rate of exhaust gas introduced into the particulate trap to increase significantly. On occasion, such an increased exhaust flow rate can prematurely snuff or otherwise blow out the regeneration burner flame or the burning particulate matter in the particulate trap itself after the ignition flame has been timely extinguished. One effect of this blow-out problem relating to the ignition flame and also to the burning particulate matter is incomplete oxidation of particulate matter accumulated within the trap.

An exhaust processor having a periodically regenerating trap oxidizer system constructed to include a means for apportioning the heat generated by the burner substantially evenly across the inlet end face of the particulate trap and throughout the trap, and a means for regulating the flow rate of the exhaust gas through the trap during regeneration would avoid the shortcomings of conventional exhaust processors by improving the oxidation of matter collected in the trap during regeneration.

According to the present invention, an improved exhaust processor having a novel particulate trap regeneration system is provided. The exhaust processor includes a housing having an inlet for introducing a combustion product containing a contaminate or other particulate matter from an engine and an outlet for exhausting filtered or otherwise treated combustion product from the housing. At least one substrate is situated in the housing to collect particulate matter introduced into the housing through the inlet.

The exhaust processor further includes a trap burner for burning particulate matter collected in the substrate. The trap burner is operable to periodically oxidize the trapped particulate matter and thereby regenerate the substrate. The exhaust processor still further includes a control means for regulating the flow rate of combustion product introduced into the housing during regeneration of the substrate. One advantage of the improved processor is that the novel control means permits combustion product to be introduced into the housing for treatment in the substrate while regeneration of that substrate is actually occurring. Another advantage of the improved processor is that the novel control means regulates the flow rate of combustion product that is actually introduced into the housing for treatment in the substrate.

The housing is desirably of "clam shell" construction although it is within the scope of the present invention to employ any suitable construction. The substrate is preferably an elongated cellular structure having opposite inlet and outlet ends. The housing is formed to include a combustion chamber situated between the housing inlet and the substrate.

The control means includes bypass means for diverting a portion of the combustion product emitted by the engine to the outside surroundings or environment so that the diverted portion bypasses the housing entirely and the remaining undiverted portion is introduced into the housing for treatment in the substrate. A conduit in communication with the exhaust manifold of the engine is provided for conducting the diverted combustion product portion to the surroundings. A valve is installed in an upstream position in the bypass conduit and is operable to permit the diverted combustion product to flow through the conduit toward the surroundings.

The control means further includes flow rate detection means for measuring the flow rate of the combustion product introduced into the housing and means for activating the bypass means to divert the combustion product toward the surroundings. The exhaust gas back pressure upstream of the substrate increases and the combustion product flow rate decreases as more and more particulate matter is collected in the substrate. In a preferred embodiment, a regeneration cycle is initiated in the exhaust processor when said back pressure exceeds a preselected threshhold value.

One aspect of the unique regeneration cycle in the present invention is the resolution of the problem relating to incomplete oxidation of particulate matter collected in the substrate due to the ignition of matter collected in the center of the trap prior to the ignition of matter collected in the periphery thereof. In particular, the regeneration means includes flame means for igniting particulate matter collected in the upstream or inlet end of the substrate and flame arrestor means for retarding a flame generated by the flame means to affect the distance the flame may travel into the substrate along its length. The flame arrestor means includes heat transmission means for conducting heat generated by the flame means away from a central portion of the inlet end face of the substrate toward the periphery thereof to cause the substrate to be substantially uniformly heated across progressive transverse cross-sections thereof to further cause generally uniform ignition of matter collected in the substrate.

As previously noted, the problem of incomplete oxidation in the substrate is caused in part by non-uniform heat distribution in the substrate. The novel heat transmission means in the present invention comprises two heat conductive dome members which cooperate to remedy this problem. The heat transmission means functions in a manner similar to a heat sink since it collects heat energy; however, it also distributes a portion of that collected energy to a generally "cooler" region of the substrate during regeneration to improve oxidation by generally uniformly heating the inlet end face of the substrate.

A first dome member is provided for intercepting and absorbing the heat energy convected from the flame means to "shield" the center of the substrate, conducting a portion of the absorbed heat energy away from the center of the substrate in radial directions toward the periphery of the inlet end of the substrate, and finally convecting the conducted heat energy portion toward the periphery of the substrate inlet end. A second dome member is provided for absorbing heat energy and conducting the absorbed heat energy from the first dome member toward the center of the substrate. The second dome member has a special shape to cause the center of the substrate to be heated to about the same temperature and at about the same rate as the first dome member operates to heat the periphery of the substrate. Thus, the first and second dome members cooperate to uniformly heat the particulate matter collected in the inlet end face of the substrate to the proper ignition temperature to improve oxidation during regeneration.

Another aspect of the unique regeneration cycle in the present invention is the resolution of the above-described blow-out problems relating to the ignition flame and to the burning particulate matter in the substrate. In particular, the bypass means further includes bypass regulator means for venting combustion product conducted past the upstream bypass valve in the bypass conduit to the outside surroundings in proportion to the flow rate of the diverted combustion product portion. The bypass regulator means includes flow rate detection means for sensing the flow rate of the diverted combustion product portion conducted through the conduit so that the bypass means can be instructed to divert more combustion product away from the substrate whenever the flow rate increases.

As previously noted, the premature flame blow-out problem and the premature burning particulate matter blow-out problem is caused in part by a rapid and sudden increase in the flow rate of the combustion product traveling past the lighted burner and/or into the substrate during regeneration of the substrate. For example, a sudden increase in the flow rate of combustion product can be brought about by rapid acceleration of the diesel engine from an idle condition to a full-throttle condition. In a preferred embodiment, all of the combustion product-conducting passageways of the exhaust processors are designed to minimize the back pressure in the system. Thus, the flow rate of the combustion product introduced into the clam-shell housing for conduction past the burner is at all times substantially equivalent to the flow rate of the combustion product intercepted by the bypass regulator means in the bypass conduit. The flow rate detection means is operable to sense the flow rate of combustion product in the bypass conduit during regeneration of the substrate and, in effect, sense the flow rate of the combustion product introduced into the clam-shell housing during regeneration. The bypass regulator means is operable in response to the flow rate detection means to cause diverted combustion product to be vented from the conduit to the outside surroundings in proportion to the flow rate of the diverted combustion product whenever said flow rate exceeds a preselected threshhold level. The threshhold level is chosen to ensure that combustion product is vented to the surroundings in sufficient quantity and at a sufficient rate to ensure that the flow rate of the remaining undiverted combustion product in the combustion chamber or in the substrate is not great enough to prematurely snuff, extinguish, or otherwise blow out the flame ignition means particulate matter burning in the substrate during regeneration of the substrate.

In this specification and in the claims, the words "an exhaust processor" are intended to refer to various types of diesel particulate filters and other particulate traps or substrates in connection with which this invention may be used.

Additional features and advantages of the invention will become apparent to those skilled in the art upon consideration of the following detailed description of a preferred embodiment exemplifying the best mode of carrying out the invention as presently perceived. The detailed description particularly refers to the accompanying figures in which.

Figure 1:
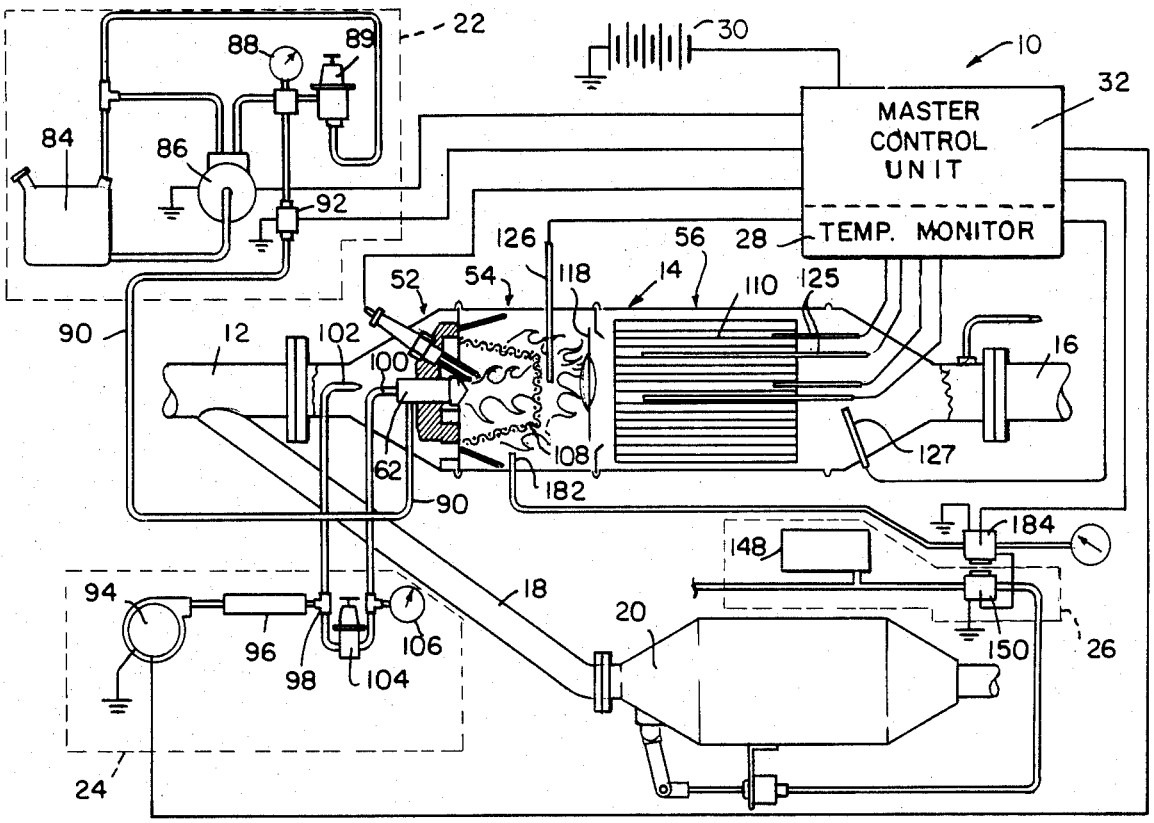
FIG. 1 is a schematic view of a preferred embodiment of the present invention showing a particulate trap burner during ignition of the particulate matter collected in a single substrate and during regeneration of the substrate.

A schematic illustration of the exhaust processor 10 of the present invention is shown in FIG. 1. The exhaust processor 10 includes an exhaust manifold pipe 12, a particulate trap burner assembly 14, an exhaust pipe 16, a bypass conduit 18, a bypass regulator assembly 20, a burner fuel supply system 22, a burner air supply system 24, a bypass valve vacuum system 26, a substrate temperature monitoring system 28, a voltage source 30, and a master control unit 32. Thus, the exhaust processor 10 of the present invention is shown to include a diesel particulate trap and burner assembly 14 in combination with a bypass exhaust flow regulator assembly 20 arranged in an exhaust system of a diesel fueled engine (not shown).

One major advantage of the exhaust processor of the present invention is that it is constructed to permit simultaneous filtration and regeneration. In other words, particulate matter entrained in an exhaust gas or other combustion product is being exposed to a particulate trap substrate at the same time that same substrate is being regenerated. It will be understood that it is within the scope of the present invention to install one or more substrates in the present exhaust processor.

Figure 2:
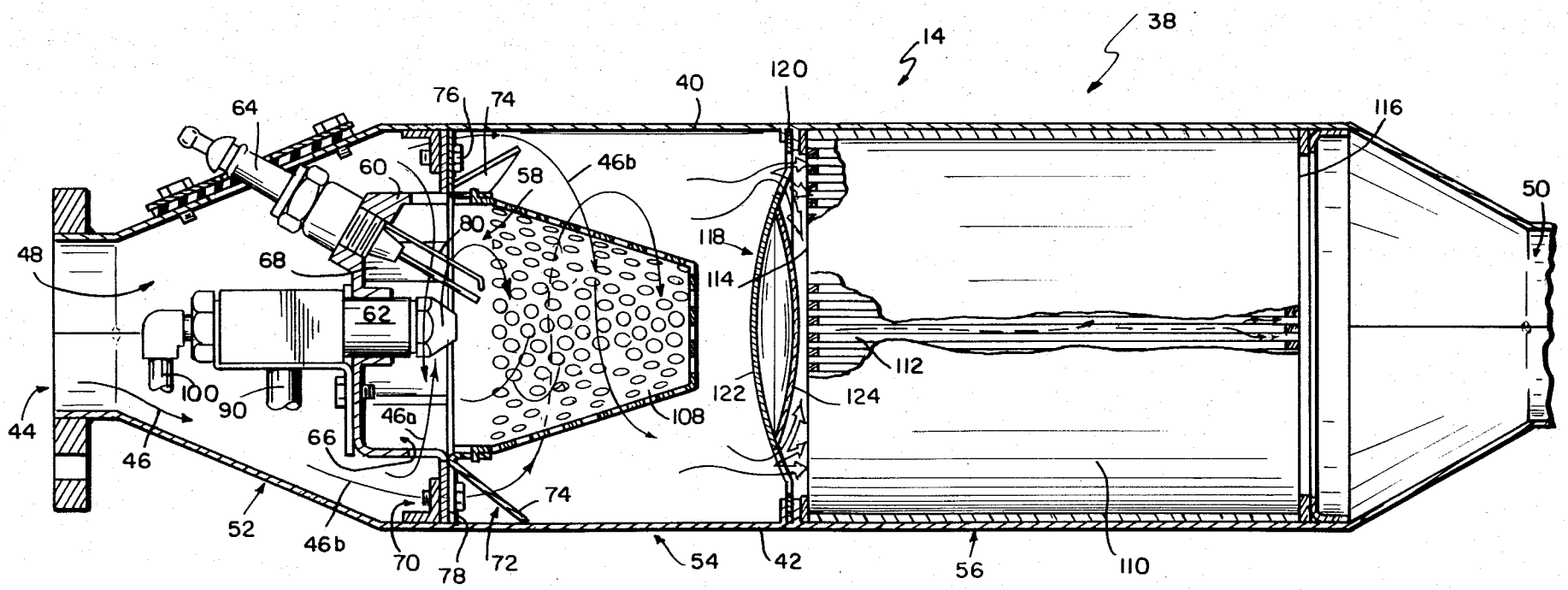
FIG. 2 is an enlarged view of a longitudinal cross-section of the embodiment of the substrate housing shown in FIG. 1 showing the burner assembly combustion chamber, heat transmission means, and the substrate.
Figure 4:
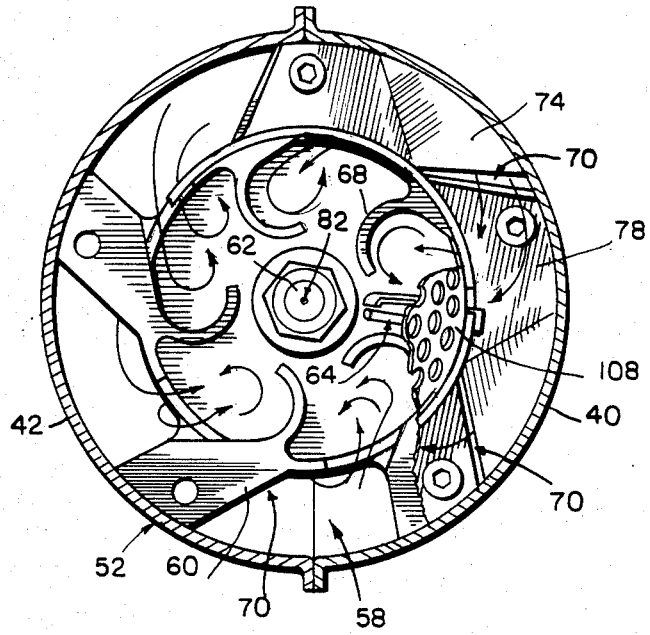
FIG. 4 is a front elevation view of the embodiment shown in FIG. 3 rotated 90° for clarity of illustration.

The particulate trap burner assembly 14 is best illustrated in FIG. 2. The trap assembly 14 includes a housing 38 of the clam shell type including an upper half shell 40 joined to a lower half shell 42. The housing 38 further includes a housing inlet 44 to receive a combustion product 46 of an engine (not shown) into a large cavity 48 formed by the marriage of the upper and lower half shells 40, 42. Also, a housing outlet 50 is provided to exhaust combustion product 46 from the housing 38.

The trap housing cavity 48 is divided into a forward inlet chamber 52, an intermediate combustion chamber 54, and a rearward substrate chamber 56. As shown in FIG. 2, the inlet chamber 52 is situated in close proximity to the housing inlet 44. The substrate chamber 56 is situated in close proximity to the housing outlet 50, and the combustion chamber 54 is situated between the two other chambers 52 and 56.

The combustion product 46 is divided into two oppositely swirling portions at the boundary between the inlet chamber 52 and the combustion chamber 54 preparatory to ignition of a mixture of the combustion product portions and an atomized air/fuel mist in the combustion chamber 54. The equipment used to atomize and ignite the air/fuel mist is housed substantially in the inlet chamber 52. The explosion takes place in the combustion chamber 54 and produces a flame which generates enough heat in the substrate chamber 56 to ignite particulate matter collected therein.

A combustion product ignition system 58 is housed in the inlet chamber 52 and includes a swirl chamber 60 for creating a plurality of small eddy-currents in the combustion product to stimulate mixing, a nozzle 62 to atomize an air/fuel mixture, and a spark plug 64 to ignite the mixture of the combustion produce and the atomized mist. The swirl chamber 60 is transversely mounted within the cavity 48 of the trap housing 38 in proximity to the boundary between the inlet chamber 52 and the combustion chamber 54 to intercept and divide the flow of exhaust gas 46 into a first component **46*a* substantially characterized by a clockwise swirling motion and a second component 46*b*** substantially characterized by a counterclockwise swirling motion.

Figure 3:
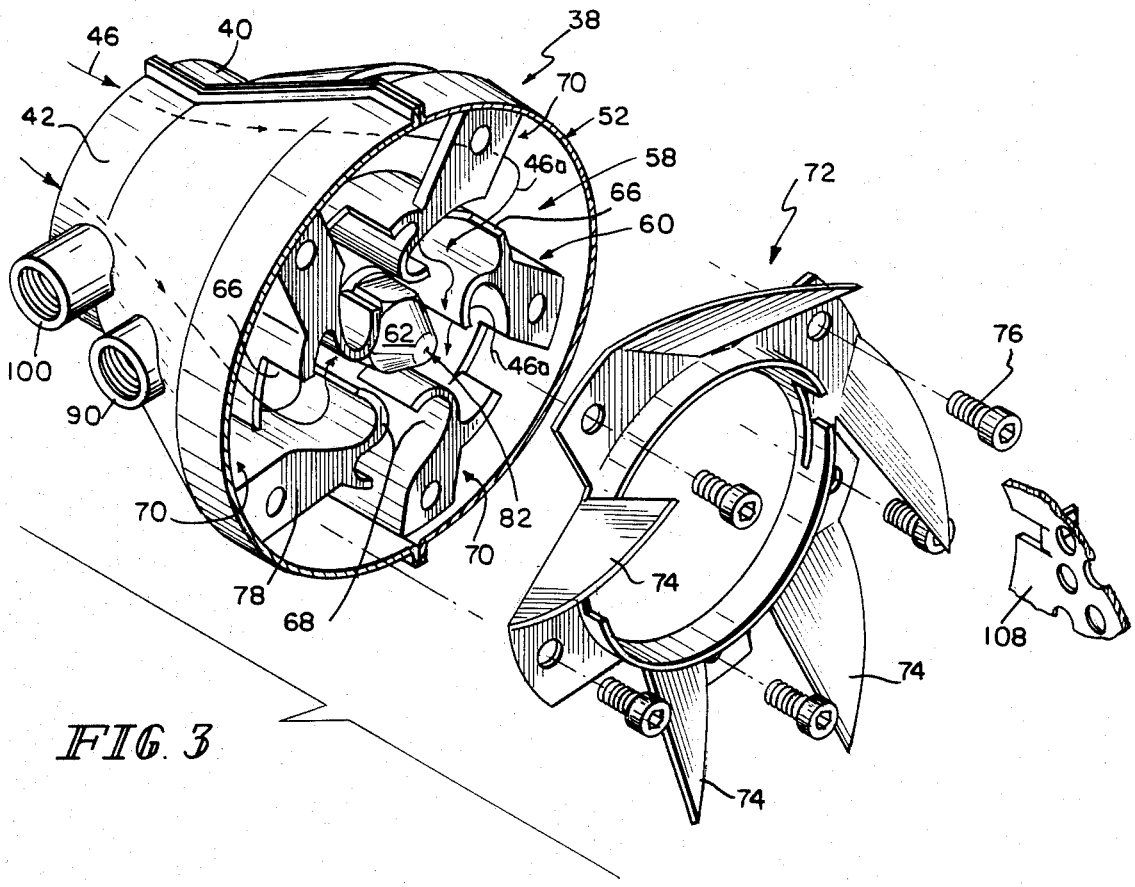
FIG. 3 is an exploded perspective view of the burner assembly shown in FIG. 2 rotated 90° for clarity of illustration with portions broken away.

As shown in FIGS. 2 and 3, the swirl chamber 60 cooperates with a portion of the interior wall of the trap housing 38 to define a continuous radially outer passageway for conducting combustion product 46 from the burner chamber 52 to the combustion chamber 54. The swirl chamber 60 is formed to include a first plurality of ports 66 for conducting the first combustion product portion **46*a* in a radially inward direction. The swirl chamber 60 further includes a plurality of radially inner vanes 68 which are situated to intercept the first combustion product portion 46*a* as it is conducted through the ports 66 (FIG. 3). These vanes 68 are shaped to swirl the combustion product 46*a* in a clockwise direction. The swirl chamber 60 is also formed to a second plurality of ports 70 for conducting the second combustion product portion 46*b*** in an axially inward direction.

A swirl plate 72 is situated in the combustion chamber 54 in proximity to the boundary between the inlet chamber 52 and the combustion chamber 54 and includes a plurality of radially outer vanes 74 which are situated to intercept the second combustion product portion **46*b* as it is conducted through the ports 70 when the swirl plate 72 is mounted by means of bolts 76 on a downstream face 78 of the swirl chamber 60. These vanes 74 are shaped to swirl the combustion product 46*b* in a counterclockwise direction. Thus, the swirl chamber 60 and the swirl plate 72** cooperate to stimulate mixing of the combustion product and atomized air/fuel mist prior to ignition.

The nozzle 62 is mounted in a central portion of the swirl chamber 60 so that the nozzle spray or mist is cast into the combustion chamber 54 as shown in FIG. 2. Desirably, the angle of nozzle spray is about 40° from the center line of the nozzle orifice. The nozzle 62 uses a low fuel and air pressure system which results in very little fuel usage. For example, the nozzle 62 uses only 0.0069 gallons of diesel fuel during a regeneration cycle having a one minute and thirty second flame ignition. Thus, if the regeneration cycle occurred after twenty miles of driving at 60 miles per hour only one gallon of fuel would be used per each 2,880 miles driven.

The spark plug 64 is mounted alongside the nozzle 62 and is used to ignite the atomized mist of fuel and air produced by the nozzle. The spark plug 64 includes extra-long electrodes 80 which extend from the inlet chamber 52 into the combustion chamber 54 into a radially outer region of the atomized mist. The spark across the electrodes 80 is located so that the maximum arc is perpendicular to the nozzle outlet orifice 82. This particular structure produces quicker ignition of the atomized mist.

The burner fuel supply system 22 delivers diesel fuel to the nozzle 62 for use during the initial flame ignition stage of the regeneration cycle. The fuel supply system 22 is schematically illustrated in FIG. 1 and includes a fuel tank 84, a fuel pump 86, a fuel pressure gauge 88, a fuel regulator 89, a fuel line 90, and a fuel solenoid valve 92. The fuel tank 84 and fuel pump 86 are conveniently the same tank and pump used by the vehicle engine. The fuel supply is regulated using the fuel regulator 89 to achieve a gauge pressure of 15.8 psi. The fuel solenoid valve 92 is mounted in the principal fuel line 90. The fuel solenoid valve 92 is formed to include a 0.002" orifice which controls the amount of fuel entering the nozzle 62. This amount of fuel results in the BTU output of the nozzle, the characteristics of the flame, its color, its violence, and its ultimate temperature. The fuel supply valve 92 also controls the on/off of the fuel flow.

The burner air supply system 24 delivers a primary source of air to the nozzle 62 to atomize the fuel delivered by the fuel supply system 22 and delivers an auxiliary source of air to the inlet chamber 52 to increase the oxygen content of the combustion product 46 introduced into the housing 38. This additional oxygen operates to improve combustion by permitting the flame to burn at a constant rate and at a constant temperature during the flame ignition during a first stage of the regeneration cycle. The auxilliary oxygen supply also improves combustion for the same reasons during a second stage of the regeneration cycle in which the particulate matter collected in the substrate 110 is permitted to burn. The air supply system 24 is schematically illustrated in FIG. 1 and includes an air pump 94, an air filter 96, a flow dividing member 98, a primary air line 100, an auxiliary air line 102, an air regulator 104, and an air pressure gauge 106. The air pump 94 provides a continuous flow of 5.5 c.f.m. to the auxiliary air line 102 for better combustion of the air/fuel mixture.

Operation of the air regulator 104 causes the air delivered to the nozzle in the primary air line 100 to be characterized by a gauge pressure of 3.5 psi. The primary air fulfills at least two needs. First, the primary air combines with the diesel fuel in the nozzle 62 to produce an atomized mist that is ignitable by the spark plug 64. Second, the primary air pressurizes the nozzle 62 during non-regeneration of the substrate to prevent the particulate matter in the combustion product 46 from entering the nozzle 62 and clogging its orifice 82 and other passages. The gauge pressure of the primary source of air is selected to exceed the maximum back pressure of the particulate trap system prior to regeneration. In addition, the primary air line 100 is connected to the nozzle 62 as shown in FIG. 2 at a position "above" the fuel supply line 90. Such an arrangement helps to stabilize the fuel in the nozzle 62 when there is no ignition taking place. This constant pressure helps to prevent unwanted fuel droplets from occurring.

Ignition of the air/fuel mixture produced by the nozzle 62 takes place in the combustion chamber 54. A mantle 108 is mounted on the swirl plate 72 to extend into the combustion chamber 54. The mantle 108 is desirably constructed of 409 stainless steel and is affixed to swirl plate 72 by means of the illustrated tabs or any suitable alternative. The mantle 108 is mounted to surround the nozzle 62 and spark plug 64 assembly, and is formed to include a plurality of holes through which a flame produced by the combustion product ignition system 58 may extend. The mantle 108 catches the atomized raw fuel that is released by the nozzle 62 moments before light-off or ignition occurs. This feature holds the mist within the mantle region and thus improves the ignition process by preventing the mist from reaching the inner walls of the housing shells 40 and 42. Further, the upstream side of the mantle 108 is positioned in relation to both sets of swirl chamber ports 66 and 70 so that two oppositely swirling combustion product components are assimilated and thoroughly mixed in the interior of the mantle 108. The two oppositely swirling combustion product components also swirl in clockwise and counter clockwise directions about the exterior of mantle 108 as illustrated in FIG. 2. The mixing action that takes place within the mantle 108 causes the combustion chamber 54 to be completely engulfed in flame during the flame ignition stage of the regeneration cycle.

At least one substrate or particulate filter core 110 is housed in the substrate chamber 56 as shown best in FIG. 2. The substrate 110 is a cylindrically-shaped monolithic cellular structure of conventional diameter and length. The substrate 110 could be a structure having a large number of thin-walled passages 112 extending longitudinally between an inlet end face 114 and an outlet end face 116 of the cellular structure.

A "spider-like" flame arrestor 118 is mounted in the combustion chamber 54 in proximity to the boundary between the combustion chamber 54 and the substrate chamber 56 to lie intermediate the mantle 108 and the inlet end face 114 of the substrate 110. The novel flame arrestor 118 is desirably constructed of 409 stainless steel and is provided to maintain a substantially uniform temperature across the inlet and face 114 of the substrate 110 and throughout the rest of the substrate 110 during the entire regeneration cycle. The flame arrestor 118 operates to conduct heat generated by the flame away from an area of concentration in the center of the inlet end face 114 and toward the periphery thereof.

Figure 5:
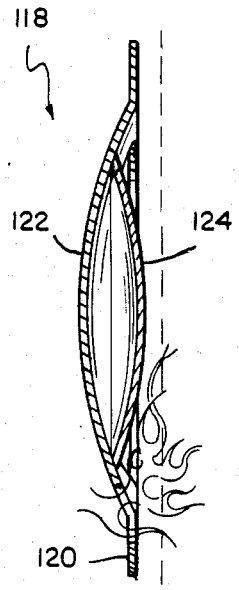
FIG. 5 is an enlarged side elevation view of the heat transmission means of the embodiment shown in FIG. 2.
Figure 6:
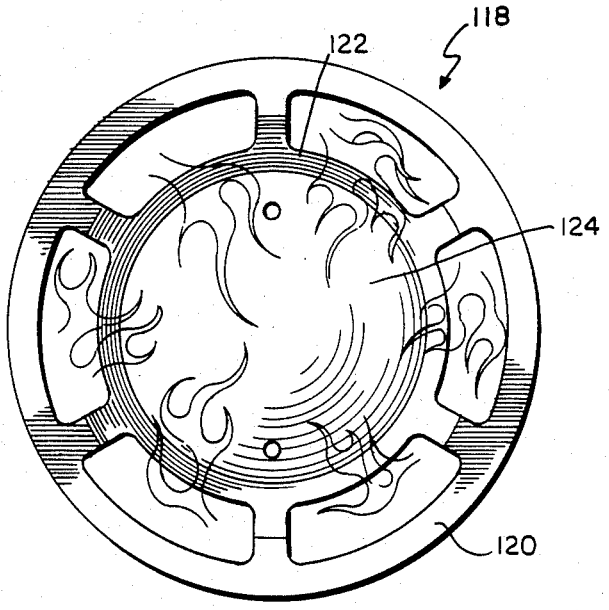
FIG. 6 is a rear elevation view of the embodiment shown in FIG. 5.

The flame arrestor 118 is of two-piece construction. The flame arrestor 118, as shown in FIGS. 2, 5, and 6, includes a radially outer flat ring member 120 and an integral radially inner first dome member 122. The convex portion of the first dome member 122 faces in the upstream direction. The first dome member 122 acts to conduct heat toward the periphery of the inlet end face 114 and away from the center thereof as part of first step toward generating a uniform temperature across the inlet end face 114 to promote simultaneous ignition of all particulate matter collected therealong. The flame arrestor 118 further includes a radially inner second dome member 124 fixed as by welding to the downstream concave portion of the first dome member 122 so that the convex portion of the second dome member 124 faces downstream. The second dome member 124 is desirably formed to include at least one vent hole to guard against explosion due to expansion of air trapped in between dome members 122 and 124.

The flame arrestor 118 is transversely mounted in the combustion chamber portion of the housing cavity 38 to intercept substantially all of the heat generated by the burner yet permit all of the combustion product to be conducted therepast into the substrate chamber 56 for treatment therein. In its mounted position, the second dome member 124 is situated in close proximity to the center of the inlet end face 114 of the substrate 110 to conduct heat toward said center portion at the proper time as part of a final step toward uniformly heating the inlet end face 114 during regeneration.

The unique shape of the first dome member 122 of the flame arrestor causes the flame generated within the mantle 108 to move along the first dome member 122 toward the periphery of the ring member 120 and through the openings therein toward the substrate 110. Moreover, heat generated by the flame is also conducted toward the periphery of the substrate. This flow of heat causes the outer peripheral area of the substrate 110 to be heated in the present exhaust processor whereas heat is usually concentrated in a center portion of a substrate in a conventional exhaust processor.

The unique shape of the second dome member 124 is designed to delay the heat from being conducted from the periphery of the first dome member 122 back toward the center of the inlet end face 114 of the substrate 110 until the periphery of the substrate has been sufficiently heated. Thus, the first and second dome members 122, 124 cooperate to provide heat transmission means for delaying the transfer of heat generated by the flame toward the center of the substrate 110 until the periphery of the trap reaches substantially a preselected temperature. When the entire inlet end face 114 has been elevated to a certain uniform temperature, the particulate matter collected therein is ignited and begins to burn. This equalization of temperature across the inlet end face helps to prevent crackage of the brittle substrate due to thermoshock. The heat generated in the flame ignition stage of the regeneration cycle is generally uniformly distributed progressively across each transverse cross-section of the substrate 110 along its length. Once the particulate matter in the upstream portion of the substrate 110 is ignited, adjacent particulate matter is also ignited and incinerated as the burn progresses downstream from the inlet end face 114 toward the outlet end face 116 of the substrate 110. This burn process continues at a substantially uniform rate even after the flame ignition stage is over and the burner flame itself has been timely extinguished.

A substrate temperature monitor system 28 is installed in the exhaust processor of the present invention to monitor the progress of the burn along the length of the substrate 110 during both the flame ignition and the burn stages of the regeneration cycle. A plurality of thermocouples 125 are installed at various points throughout the substrate 110 as shown in FIG. 1. Thermocouples 126 and 127 are also installed as shown in FIG. 1 to monitor the temperature in front of and behind the substrate 110. The "completeness" of the burn during each regeneration cycle can be monitored using this temperature monitor system.

The object of the novel bypass assembly 20 is to reduce the pressure and flow through the particulate trap housing during the flame ignition stage and also the burn stage of the regeneration cycle. Such a reduction is necessary during acceleration and deceleration of the diesel engine to prevent blow-out of the flame generated by the nozzle 62 and spark plug 64 assembly within the mantle 108 and to prevent blow-out of the burning particulate matter as the burn progresses along the length of the substrate. Premature extinguishment of the flame and of the subsequent burn causes incomplete burning and oxidation of the particulate matter collected in the substrate 110. Reduction of the flow rate of combustion product **46*a* and 46*b* past the nozzle 62 and relief of pressure within the combustion chamber 54 is accomplished by diverting a portion of the combustion product 46 emitted by the engine (not shown) away from the trap burner assembly 14** for distribution to the outside surroundings during regeneration.

Figures 7, 8, 9:
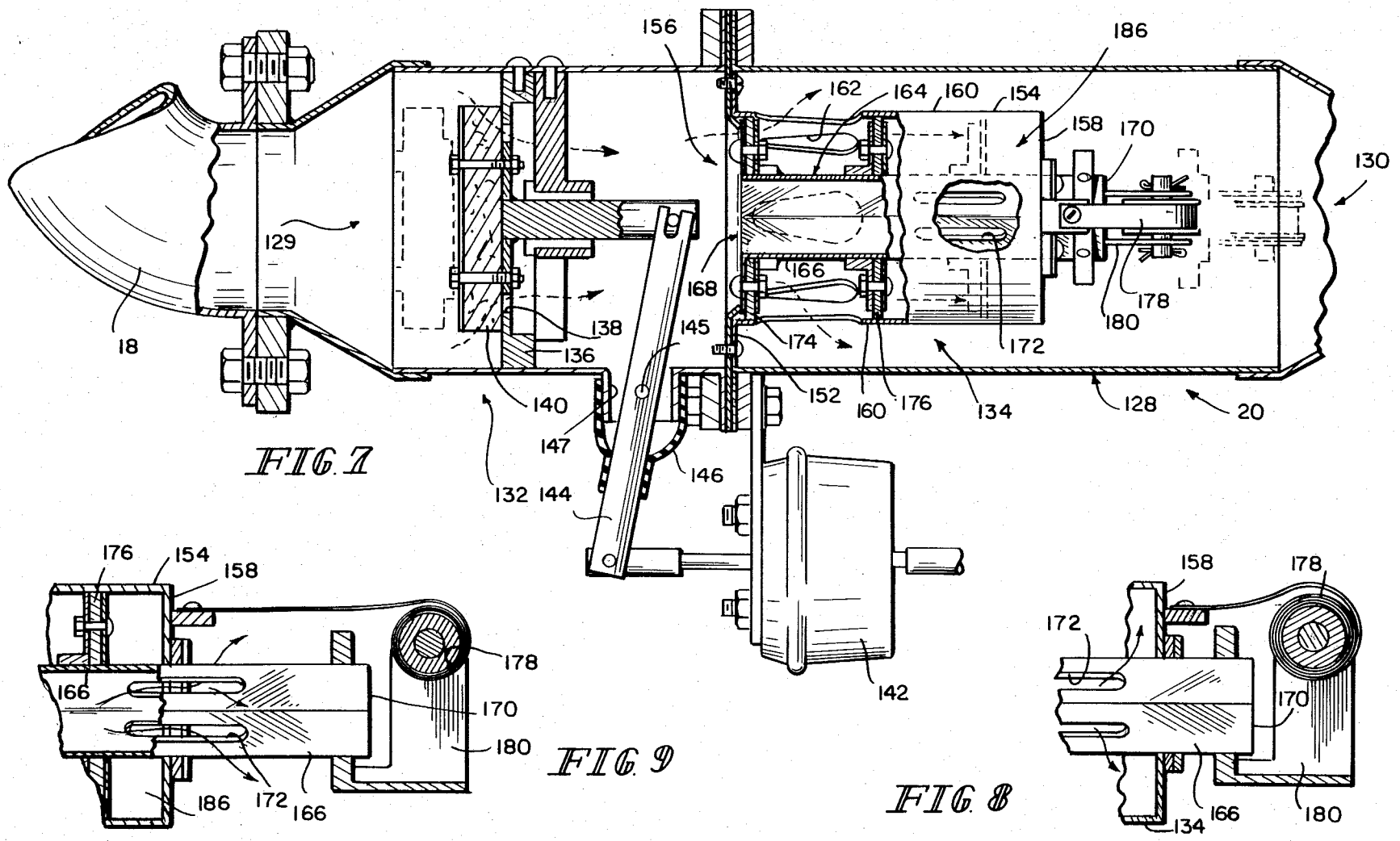
FIG. 7 is an enlarged view of a longitudinal cross-section of the embodiment of the bypass means shown in FIG. 1 showing the bypass valve and the bypass regulator means.
FIG. 8 is an enlarged side elevation view of the downstream end of the bypass regulator means of the embodiment of FIG. 7 showing one operating position.
FIG. 9 is an enlarged side elevation view of the embodiment shown in FIG. 8 in a second operating position.

The bypass assembly 20 includes a housing 128 of a suitable construction as shown best in FIG. 7. The bypass housing 128 includes a housing inlet 129 in communication with the exhaust manifold pipe 12 via the bypass conduit 18 and a housing outlet 130 for exhausting diverted combustion product to the outside surroundings. The bypass assembly 20 further includes a bypass on/off valve 132 and regulator means 134 for selecting the quantity of diverted combustion product that is exhausted to the surroundings through the bypass assembly 20. The bypass regulator 134 operates to vent combustion product from the conduit 18 to the outside surroundings or enviornment in proportion to the flow rate of the diverted combustion product portion. Thus, the bypass regulator means 134 actually functions to directly regulate the actual flow rate of combustion product through the burner chamger 52, combustion chamber 54, and the substrate chamber 56 during the entire regeneration cycle. Such regulation advantageously prevents premature extinguishment of either the flame in the combustion chamber 54 or of the burning particulate matter in the substrate chamber 56 during regeneration to improve the efficiency of the regeneration process. The bypass on/off valve 132 is situated within the bypass housing 128 in an upstream position relative to the bypass regulator means 134.

The bypass on/off valve 132 includes a barrier 136 or valve seat transversely mounted in an upstream portion of the bypass housing 128 in close proximity to the inlet end 129. The barrier 136 is formed to include a plurality of centrally situated apertures 138 for conducting diverted combustion product toward the bypass regulator means 134. A plunger or valve member 140 is mounted in the upstream barrier 136 for movement between an aperture-closing position shown in FIG. 7 and an aperture-opening position shown in dotted lines in FIG. 7. A vacuum valve 142 is provided for actuating the bypass on/off valve 132 and is coupled to the plunger 140 by an interconnecting rod 144 pivotally supported by pin 145 on pipe or coupling 147 to extend through the wall of the bypass regulator assembly 20. A flexible seal 146 is slipped in place about coupling 147 to embrace the rod 144 and thereby prevent unwanted leakage of combustion product from the bypass housing 128. The vacuum valve 142 and the bypass on/off valve 132 are operated by means of the bypass vacuum valve control system 26 shown in FIG. 1. The vacuum valve control system 26 includes a vacuum tank 148 coupled to the vehicle vacuum source (not shown) and a vacuum solenoid 150 responsive to the master control unit 32.

The bypass regulator means 134 includes a downstream barrier 152 transversely mounted in the bypass housing 128. The barrier 152 is formed to include a central aperture for conducting diverted combustion product toward the surroundings. A "coffee can-shaped" ventilation shell 154 is formed to include an open mouth 156 and includes having a bottom wall 158 and a cylindrical side wall 160. The ventilation shell 154 is mounted on the downstream barrier 152 so that its open mouth 156 is in communication with the central aperture of the downstream barrier 152. The sidewall 160 of the ventilation shell 154 is formed to include a plurality of circumferentially spaced-apart teardrop-shaped flow relief slots 162 as shown in FIG. 7.

The bypass regulator means 134 further includes a piston 164 mounted in the ventilation shell 154 for reciprocating movement between an aperture-closed position shown in FIG. 7 and an aperture-opening position shown in dotted lines in FIG. 7. The piston 164 includes a hollow rod or stem 166 that is formed to include an open upstream end 168, a closed downstream end 170, and a plurality of rearwardly situated back pressure relief slots 172. The back pressure relief slots 172 are positioned to lie wholly within the interior of the ventilation shell 154 when the piston 164 is in its aperture-closed position. The piston further includes a thin first piston cylinder 174 and a thin second piston cylinder 176. Each cylinder 174, 176 is rigidly fixed to the hollow rod 166 so that the first cylinder 174 is upstream of the teardrop-shaped relief slots 162 and the second cylinder 176 is downstream of slots 162 when the piston 164 is in its aperture-closing position. The bypass regulator means 134 still further includes a constant-force spring 178 or the like rotatably mounted on a spring bracket 180. One end of the constant-force spring 178 is rigidly fixed to the downstream end face of the bottom wall 158 of the ventilation shell 154 and the other end is rigidly fixed rotationally journaled on the spring bracket 180 to yieldably urge the piston 164 toward its aperture-closed position. The spring bracket 180 is rigidly fixed to the movable downstream closed end 170 of the hollow rod 166.

The particulate trap burner is activated in the following manner to begin the regeneration cycle to oxidize and otherwise incinerate particulate matter collected in the substrate 110 during normal operation of the diesel engine. It is within the scope of the present invention to activate the particulate trap burner in many different ways (e.g. mileage, time, flow rate or pressure of combustion product in housing 38, or the like). In the embodiment shown in FIG. 1, a static pressure tube 182 is mounted in a wall of the combustion chamber 54. The static pressure tube 182 is coupled to a pressure-sensitive solenoid 184 in communication with the master control unit 32 and a pressure meter. It will be understood that the ambient pressure within the combustion chamber 54 will increase as the substrate 110 becomes more and more clogged with particulate matter. When the pressure has reached a threshhold level of, say, for example, four inches of Mercury in addition to the normal pressure of engine operation, the solenoid 184 will instruct the master control unit 32 to begin the regeneration cycle. The following three steps then take place at about the same time: the fuel solenoid valve 92 is activated to supply fuel to the nozzle 62, the master control unit 32 activates the vacuum valve 142 to move the plunger 140 of the bypass on/off valve 132 to its aperture-opening position, and the spark plug 64 is energized to ignite the air/fuel mixture introduced into the combustion chamber 54. Actuation of the bypass valve causes a greater portion of the combustion product normally bound for treatment in the substrate 110 to be diverted into the bypass housing 128. The proper quantity of combustion air is available during regeneration and non-regeneration periods since the primary air prevents cloggage of the nozzle 62 and the auxiliary air is never turned off. Once ignition has occurred, the flame arrestor 118 intercepts the flame to substantially remedy the above-described incomplete oxidation problem.

The bypass regulator means 134 operates in the following manner to reduce the flow rate of combustion product through the combustion chamber 54 to prevent incomplete regeneration of the substrate due to premature extinguishment of the flame generated during the ignition stage of the regeneration cycle and due to premature extinguishment of the burning particulate matter during both the flame ignition and burning stages of the regeneration cycle. The diverted combustion product portion is characterized by a certain flow rate and pressure and bears upon the forwardly-presented upstream face of the first piston cylinder 174. At idle, the engine flow and pressure are so low that the piston 164 moves very little. However, it does move to the extent movement is required to prevent premature extinguishment of the burner flame and burn. At higher r.p.m., the combustion flow rate and pressure significantly increases causing the first piston cylinder 174 to move rearwardly to expose at least a portion of the teardrop-shaped flow rate relief slots 162 to reduce the pressure and flow rate in the combustion chamber 54. The teardrop shape importantly causes non-linear venting of diverted combustion product toward the environment. It should be noted that it is within the scope of the present invention to activate the bypass means and/or the bypass regulating means in response to a preselected threshhold pressure within the combustion chamber sensed by the solenoid/static pressure tube assembly.

In addition, the diverted combustion product portion is also allowed to flow into the open upstream end 168 of the hollow rod 166 and to then exit through the back pressure relief slots 172 in the hollow rod 166 to pressurize a rear chamber 186 of the ventilation shell 154 as shown best in FIG. 8. The rearward face of the second piston cylinder 176 and the forward face of the bottom wall 158 and sidewall 160 of the ventilation shell 154 cooperate to define the rear chamber 186. This pressurization of the rear chamber 186 functions as an "air spring" and brakes or otherwise slows rearward motion of the piston 164 induced by the flow rate and pressure of the diverted combustion product. Thus, piston 164 movement is slowed at low engine r.p.m. where higher pressure and flow is desirable. As the engine accelerates, the flow and pressure force the piston 164 to move further in a rearward direction overcoming the force exerted by said "air spring" to expose even more open area of the special non-linear teardrop-shaped relief slots 162 thus conducting the flow into that portion of the bypass housing 128 in communication with the surroundings.

Referring now to FIG. 9, at a higher engine r.p.m. the piston 164 is caused to move rearward. At a certain preselected point, the back pressure relief slots 172 in the hollow piston rod 166 move out of the rear chamber 186 and through the bottom wall 158 of the ventilation shell 154 to cause a portion of the combustion product conducted into the rear chamber to be vented to the outside surroundings through the backpressure relief slots 172 so that the piston 164 moves more quickly to expose a larger cross-section portion of the non-linear teardrop-shaped relief slots 162. Thus, the back pressure relief slots 172 operate to vent more combustion product to the surroundings when the flow rate of the combustion product proportionately equals or exceeds a selected level. Thus, the bypass regulator 134 of the present invention regulates the flow rate of combustion product in the combustion chamber 54 to substantially prevent flame and burn blow-out and solve the premature flame and burn extinguishment problem.

The constant-force spring 178 operates to return the piston/rod assembly toward its aperture-closing position whenever the pressure and flow subsides due to lower engine speed. The end of the constant-force spring 178 is attached to the fixed ventilation shell 154 so that the spring 178 operates to yieldably urge the piston 164 in an upstream direction.

One of the most important aspects of an exhaust processor having a regenerating substrate is its ability to meet EPA and state emissions/particulate requirements. The exhaust processor of the present invention is preferably operated using the following two-stage two and one-half minute regeneration cycle. Stage one comprises a flame ignition stage lasting one and one-half minutes in which the spark plug 64 ignites the atomized air/fuel mixture generated within the mantel 108 to ignite the carbon and other particulate matter collected in the substrate 110. Stage two comprises a particulate matter burn stage lasting about one minute in which the particulate matter collected in the substrate 110 continues to burn even after the flame has been timely extinguished.

The bypass regulator means 134 is needed to ensure the proper c.f.m. flow rate in the substrate chamber 56 during the second burn stage to maintain a proper burn schedule after the flame has been timely extinguished. This situation is analogous to a common situation from Boy or Girl Scout days when one lit tinder with a match or with flint and steel and then blew on it to get a fire going in the tinder. If one blew too much the fire went out and if one blew too little the fire burned exceedingly slow. In the same way, the bypass regulator 134 functions to maintain the proper flow rate of combustion product through the substrate 110 during the second burn stage of the regeneration cycle to prevent premature extinguishment of the burn after the flame itself has been snuffed and to maintain the burn at the proper burn rate to ensure that substantially all of the particulate matter collected in the substrate 110, even that matter collected in proximity to the outlet end face 116 of the substrate 100, will be oxidized before the regeneration cycle ends.

Figure 10:
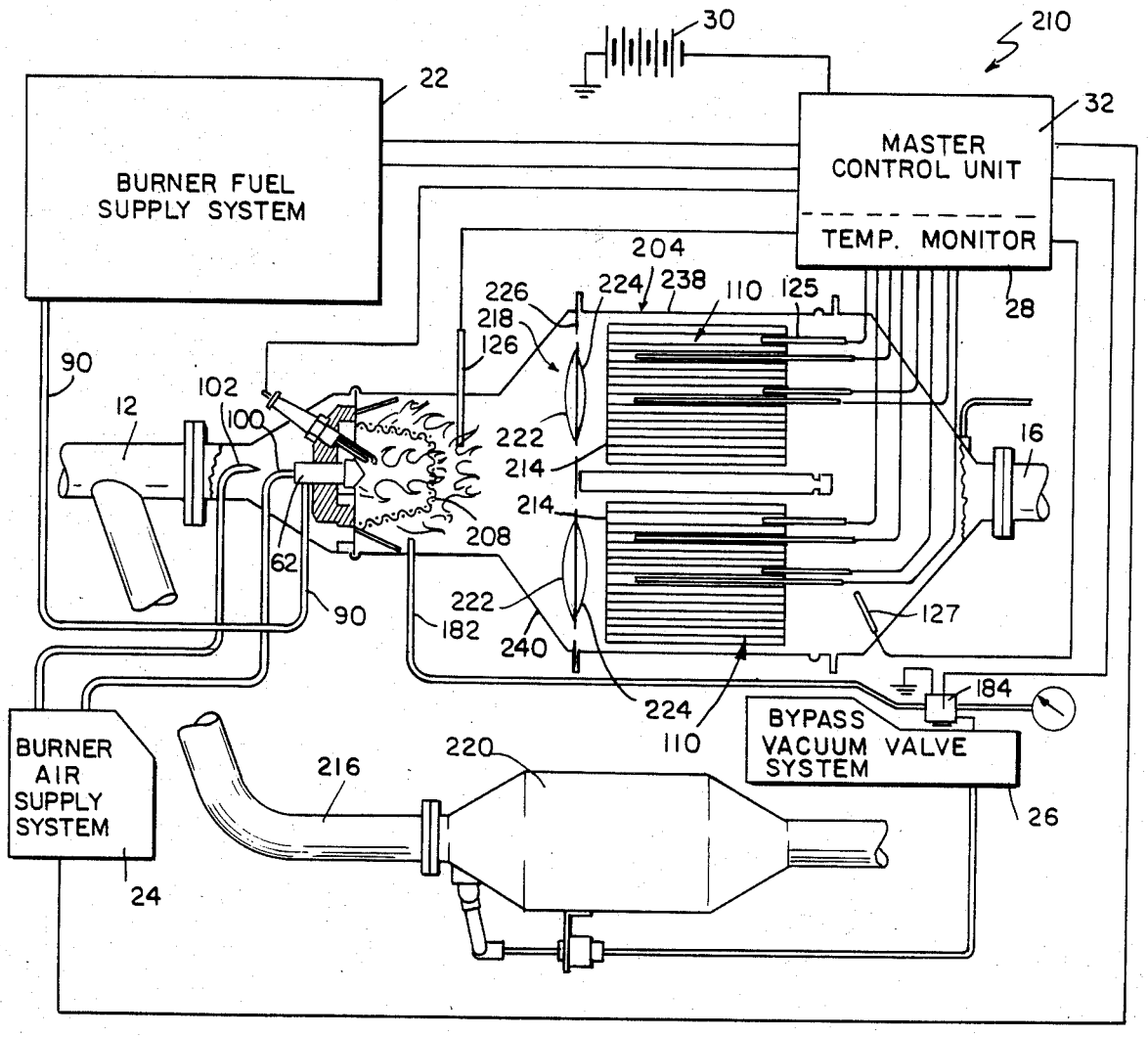
FIG. 10 is a schematic view of another preferred embodiment of the present invention showing a particulate trap burner during ignition of the particulate matter during ignition of the particulate matter collected in a pair of substrates and during regeneration of the substrate.
Figure 11:
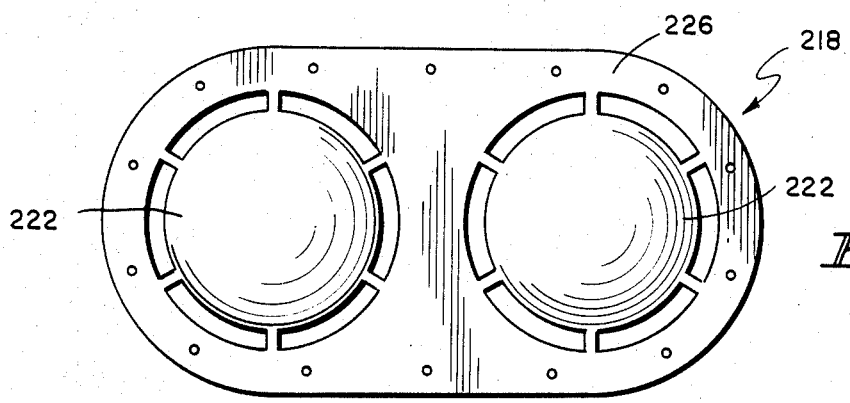
FIG. 11 is a rear elevation view of the heat transmission means of the embodiment of FIG. 10.

In another embodiment of the invention illustrated in FIGS. 10 and 11, those elements referenced by numbers identical to those in FIGS. 1–9 perform the same or similar function. In the embodiment shown in FIG. 10, the exhaust processor 210 is constructed to include a particulate trap assembly 204, a bypass conduit 216, and a bypass regulator system 220. The trap assembly 204 includes a housing 238 of a size sufficient to house two substrates 110 as illustrated in FIG. 10. A flame arrestor 218 is mounted to lie upstream of the two substrates 110 and intercepts the flame generated within the mantle 208 in the same manner as flame arrestor 118 of the other processor embodiment. Flame arrestor 218 is also desirably constructed of 409 stainless steel and includes a pair of laterally spaced apart first dome member 222 and a pair of companion laterally spaced apart second dome members 224. These dome members are held in mutually fixed relation by an arrestor plate 226 as illustrated in FIGS. 10 and 11. The housing 238 is shaped to define a conical section 240 between the mantle 208 and the substrates 110 to conduct the flame from the mantle 208 toward each of the two first dome members 222 and the two second dome members 224 to evenly distribute heat across the forwardmost face 214 of each of the substrates 110. Thus, dual flame arrestor 218 operates in a manner similar to that of single flame arrestor 118. The bypass conduit 216 and the bypass regulator system 220 is constructed in the same manner as conduit 18 and system 20 but of larger dimensions to regulate the flow of a greater quantity of combustion product. The exhaust processor 210 is designed for use with trucks or other vehicles having larger engines. Thus, it is necessary to provide an exhaust processor having a larger particulate trap capacity and flow regulation capacity. It will be appreciated that the embodiment of FIG. 10–11 is operable in the same manner as the embodiment of FIGS. 1–9.

Although the invention has been described in detail with reference to certain preferred embodiments and specific examples, variations and modifications exist within the scope and spirit of the invention as described and defined in the following claims:

What is claimed is:

1. An exhaust processor assembly for treating combustion product emitted by an engine, the combustion product having particulate matter entrained therein, the exhaust processor comprising a housing including an inlet for introducing combustion product into the housing and an outlet for exhausting combustion product from the housing, substrate means for collecting particulate matter introduced into the housing through the inlet, regeneration means for burning particulate matter collected in the substrate means at a selected regeneration rate, and variable flow control means for varying intermittently the flow rate of combustion product introduced into the housing during regeneration of the substrate means to regulate the rate of regeneration activity in the substrate means.

2. The exhaust processor of claim 1 wherein the regeneration means includes flame means for igniting at least a portion of the particulate matter collected in the substrate means, and flame arrestor means, situated intermediate the flame means and the substrate means, for retarding a flame generated by the flame means to evenly apportion the advance of the flame through the substrate means.

3. The exhaust processor of claim 2 wherein the substrate means includes a particulate trap having an inlet end face and an outlet end face, and the flame arrestor means includes heat transmission means for conducting heat generated by the flame means away from a central portion of the inlet end face of the particulate trap toward a peripheral portion thereof to cause the particulate trap to be substantially uniformly heated across a transverse cross-section thereof.

4. The exhaust processor of claim 3 wherein the heat transmission means further includes means for delaying the transfer of heat generated by the flame means toward the center of the particulate trap until the periphery of said trap reaches substantially a preselected temperature.

5. The exhaust processor of claim 1 wherein the regeneration means includes flame means for igniting at least a portion of the particulate matter collected in the substrate means, and heat transmission means, situated intermediate the flame means and the substrate means, for conducting heat generated by the flame means away from a central portion of the inlet end face of the particulate trap toward a peripheral portion thereof to cause the particulate trap to be substantially uniformly heated across a transverse cross-section thereof.

6. The exhaust processor of claim 1 wherein the regeneration means includes nozzle means for spraying a mixture of fuel and air toward the substrate means, and primary air supply means for introducing a first current of air into the nozzle means to atomize fuel delivered thereto.

7. The exhaust processor of claim 6 wherein the pressure of said first current of air is pre-selected to exceed the back pressure caused by the substrate means such that the introduction of air into the nozzle means by the primary air supply means operates to prevent contamination of the nozzle means from particular matter.

8. The exhaust processor of claim 6 wherein the regeneration means further includes auxiliary air supply means for introducing a second current of air into the housing to increase the amount of oxygen in the combustion product introduced into the housing.

9. The exhaust processor of claim 1 wherein the regeneration means comprises first swirl means for swirling one portion of the combustion product introduced into the housing in a first direction, second swirl means for swirling another portion of the combustion product introduced into the housing in a second opposite direction, a mantle for receiving the oppositely swirling combustion product portions generated by the first and second swirl means, and flame means for igniting at least the combustion product received in the mantle to produce a flame for igniting particulate matter collected in the substrate means.

10. The exhaust processor of claim 9 wherein the first swirl means includes a swirl chamber formed to include a first plurality of ports for conducting the one combustion product portion in a radially inward direction in relation to the housing and a second plurality of ports for conducting the another combustion product portion in an axial direction in relation to the housing toward the substrate means, the swirl chamber further includes a plurality of vanes shaped to swirl the one radially inwardly conducted combustion product portion in the first direction, and the second swirl means includes a swirl plate mounted in proximity to a downstream face of the swirl chamber, the swirl plate including a plurality of vanes positioned to intercept the axially inwardly conducted combustion product portion delivered from the swirl chamber and shaped to swirl said combustion product portion in the second opposite direction to stimulate mixing of both combustion product portions in and about the mantle.

11. The exhaust processor of claim 1 wherein the control means includes bypass means for diverting a portion of the combustion product emitted by the engine to the surroundings such that the diverted portion bypasses the housing and the remaining undiverted portion is introduced into the housing for treatment in the substrate means.

12. The exhaust processor of claim 11 wherein the control means further includes means for activating the bypass means to divert the combustion product such that acceleration of the engine will not cause the flow rate of combustion product conducted through the housing to exceed a preselected level to prematurely extinguish the regeneration means.

13. The exhaust processor of claim 12 wherein the substrate means is situated within the housing, the housing is formed to include a combustion chamber intermediate the inlet and the substrate means, and the control means further includes pressure detection means for sensing the ambient pressure within the combustion chamber.

14. The exhaust processor of claim 13 further comprising ignition means, responsive to a selected pressure in the housing sensed by the pressure detection means, for activating the regeneration means.

15. The exhaust processor of claim 13 wherein the bypass activating means is responsive to a preselected threshhold pressure within the combustion chamber sensed by the pressure detection means to cause said combustion product portion to be diverted to the surroundings whenever the ambient pressure within the combustion chamber exceeds the threshold pressure.

16. The exhaust processor of claim 13 further comprising ignition means, responsive to the pressure detection means, for activating the regeneration means whenever the ambient pressure within the combustion chamber exceeds the preselected threshhold pressure.

17. The exhaust processor of claim 11 wherein the bypass means includes a conduit for conducting the diverted combustion product portion to the surroundings, and valve means, situated in the conduit, for selectively allowing the diverted combustion product portion to flow through the conduit toward the surroundings.

18. The exhaust processor of claim 17 wherein the valve means includes an upstream barrier transversely mounted in the conduit, the upstream barrier being formed to include at least one aperture, a plunger mounted in the upstream barrier for movement between an aperture-opening position and an aperture-closing position, and plunger actuating means for moving the plunger to one of its aperture-opening positions to conduct the diverted combustion product portion away from the regeneration means during regeneration of the substrate means and its aperture-closing position to block the flow of combustion product toward the surroundings to cause substantially all of the combustion product emitted by the engine to be treated by the substrate means.

19. The exhaust processor of claim 17 wherein the bypass means further includes bypass regulator means, situated in the conduit, for venting combustion product from the conduit to the surroundings in proportion to the flow rate of the diverted combustion product portion.

20. The exhaust processor of claim 16 wherein the housing is formed to include a combustion chamber intermediate the inlet and the substrate means, the bypass regulator means includes pressure detection means for sensing the ambient pressure within the combustion chamber, and the bypass regulator means is responsive to the pressure detection means to cause combustion product to be vented from the conduit to the surrounding whenever the ambient pressure within the combustion chamber exceeds a preselected threshhold level.

21. The exhaust processor of claim 19 wherein the bypass regulator means includes flow rate detection means for sensing the flow rate of the diverted combustion product portion conducted through the conduit to cause the diverted combustion product portion to be vented toward the surroundings in proportion to the sensed flow rate.

22. The exhaust processor of claim 21 wherein the flow rate detection means includes a downstream barrier transversely mounted in the conduit, the downstream barrier being formed to include a central aperture, a ventilation shell having a side wall and an open mouth, the side wall of the ventilation shell depending from a downstream side of the downstream barrier to cause the ventilation shell to receive substantially all of the diverted combustion product caused to flow through the central aperture of the downstream barrier, the side wall of the ventilation shell being formed to include at least one vent hole for exhausting combustion product to the surroundings therethrough, and a piston mounted in the ventilation shell for reciprocating movement between an aperture-opening position and an aperture-closing position, the piston including first piston face means, responsive to the flow rate of the diverted combustion product portion, for moving the piston toward its aperture-opening position to expose the at least one vent hole in the side wall of the ventilation shell to cause a first quantity of said combustion product to be exhausted to the surrounding therethrough.

23. The exhaust processor of claim 22 wherein the piston includes second piston means for slowing movement of the piston toward its aperture-opening position, and the bypass regulator means includes a rear chamber defined by the ventilation shell and the second piston means, and means for conducting a second quantity of the diverted combustion product portion into the rear chamber to cause said second quantity to operate on the second piston means to slow movement of the piston toward its aperture-opening position.

24. The exhaust processor of claim 23 wherein the conducting means is formed to include means for distributing at least a portion of the second quantity of the diverted combustion product to the surrounding.

25. The exhaust processor of claim 22 wherein the bypass regulator means further includes spring means for yieldably urging the piston toward its aperture-closing position.

26. An exhaust processor assembly for treating combustion product emitted by an engine, the combustion product having particulate matter entrained therein, the exhaust processor comprising treatment means for conducting combustion product along a first path at a selected flow rate, the treatment means including a housing including an inlet for introducing combustion product into the housing and an outlet for exhausting combustion product from the housing, substrate means, positioned within the housing, for collecting particulate matter introduced into the housing through the inlet, and regeneration means for burning particulate matter collected in the substrate means, and bypass means for conducting combustion product along a second path to cause a selected portion of combustion product to bypass the housing for exhaustion to the surroundings and to cause the remaining portion of combustion product to enter the housing for treatment by the substrate means and to assist the burning process in the substrate means, the bypass means including variable regulator means for varying intermittently the quantity of combustion product that is exhausted to the surroundings through the bypass means to regulate the flow rate of combustion product through the housing during operation of the regeneration means.

27. The exhaust processor of claim 26 wherein the regulator means includes valve means for activating the bypass means during regeneration of the substrate means.

28. A regenerator for an elongated particulate trap having an entry face and an exit fact, the regenerator comprising a fuel supply nozzle, a fuel ignitor for starting a burning flame, means for providing an even distribution of said flame over said entry face to start a burn of the trapped particulate matter entrained in an engine combustion product, and control means for advancing burning progressively evenly from the entry face through the particulate trap to the exit face, the control means including means for regulating the flow of combustion product through the particulate trap.

29. An exhaust processor assembly for treating combustion product emitted by an engine, the combustion product having particulate matter entrained therein, the exhaust processor comprising a housing including an inlet for introducing combustion product into the housing and an outlet for exhausting combustion product from the housing, substrate means for collecting particulate matter introduced into the housing through the inlet, regeneration means for burning particulate matter collected in the substrate means, and means for apportioning the heat generated by the regeneration means substantially evenly throughout the substrate means.

30. The exhaust processor of claim 29 wherein the regeneration means comprises first swirl means for swirling one portion of the combustion product introduced into the housing in a first direction, second swirl means for swirling another portion of the combustion product introduced into the housing in a second opposite direction, a mantle for receiving the oppositely swirling combustion product portions generated by the first and second swirl means, and flame means for igniting at least the combustion product received in the mantle to produce a flame for igniting particulate matter collected in the substrate means.

31. A method of treating a combustion product emitted by an engine, the combustion product having particulate matter entrained therein, the method comprising the steps of:

introducing the combustion product into a particulate trap housing having an inlet and an outlet at a selected flow rate, collecting particulate matter introduced into the housing in a particulate trap situated in the housing, burning the particulate matter collected in the particulate trap to regnerate the particulate trap, varying the flow rate of the combustion product introduced into the housing during the burning step to prevent premature extinguishment of the ignited particulate matter in the trap.

32. The method of claim 31 wherein the introducing step further comprises the steps of swirling a portion of the combustion product in a first direction, swirling another portion of the combustion product in a second opposite direction, combining the oppositely swirling combustion product portions in a mantle mounted within the housing to stimulate mixing of the combustion product prior to lighting a flame in the mantle.

33. The method of claim 31 wherein the burning step comprises the steps of lighting a flame in the particulate trap housing at a point situated intermediate the housing inlet and an inlet end face of the particulate trap, to generate heat within the housing to ignite the particulate matter collected in the trap, and conducting heat generated by the flame away from a central portion of the inlet end face of the particulate trap toward a peripheral portion thereof to cause the particulate trap to be uniformly heated across a transverse cross-section thereof.

34. The method of claim 33 wherein the burning step further comprises the steps of extinguishing the flame in the particulate trap that was lit during the lighting step after a pre-determined length of time, and allowing the particulate matter collected in the trap and ignited by the flame to continue burning until the particulate trap is substantially regenerated.

35. The method of claim 31 wherein the varying step further comprises the step of reducing the flow rate of the combustion product introduced into the housing during the burning step.

36. The method of claim 35 wherein the regulating step further comprises the steps of diverting a portion of the combustion product emitted by the engine along a bypass conduit to bypass the housing during regeneration of the substrate means, venting a quantity of the diverted combustion product portion toward the surroundings, and selecting a quantity of combustion product to be vented in proportion to one of the flow rate or the pressure of the diverted combustion product portion.

37. The method of claim 36 wherein the selecting step further comprises the steps of sensing the flow rate of the diverted combustion product portion, and delaying the venting step until the flow rate sensed during the sensing step equals or exceeds a preselected threshhold level.

38. The method of claim 36 wherein the selecting step further comprises the steps of measuring the ambient pressure of combustion product within a combustion chamber formed in the housing intermediate the housing inlet and the particular trap, and delaying the diverting step and the venting step until the ambient pressure measured during the measuring step equals or exceeds a preselected threshhold level.

39. The method of claim 36 wherein the venting step further comprises the steps of exposing a piston mounted for reciprocating movement within a ventilation shell in communication with the upstream portion of the bypass conduit to the diverted combustion product portion to cause the piston to move within the ventilation shell in a downstream direction in proportion to the flow rate of the diverted combustion product portion, distributing a first quantity of the diverted combustion product portion to the surroundings through at least one flow rate relief slot formed in the ventilation shell.

40. The method of claim 39 wherein the venting step further comprises the steps of conducting a second remaining quantity of the diverted combustion product portion into a rear chamber defined by the ventilation shell which is fixed to the bypass conduit and the piston to slow rearward movement of the piston caused by exposure of the piston to combustion product during the exposing step, and, subsequent to the conducting step, distributing at least a portion of the second quantity of the diverted combustion product to the surroundings through at least one back pressure relief slot formed in the piston.

41. The exhaust processor of claim 1, wherein the control means is activated only during regeneration of the substrate means.

42. An exhaust processor assembly for treating combustion product emitted by an engine, the combustion product having particulate matter entrained therein, the exhaust processor comprising a housing including an inlet for introducing combustion product into the housing and an outlet for exhausting combustion product from the housing, substrate means for collecting particulate matter introduced into the housing through the inlet, regeneration means for burning particulate matter collected in the substrate means at a selected regeneration rate, and variable flow control means responsive to back pressure in the housing for varying intermittently the flow rate of combustion product introduced into the housing during regeneration of the substrate means to regulate the rate of regeneration activity in the substrate means.

43. The exhaust processor of claim 42 wherein the control means includes bypass means for diverting a portion of the combustion product emitted by the engine to the surroundings such that the diverted portion bypasses the housing and the remaining undiverted portion is introduced into the housing for treatment in the substrate means.

44. A method of treating a combustion product emitted by an engine, the combustion product having particulate matter entrained therein, the method comprising the steps of:

introducing the combustion product into a particulate trap housing having an inlet and an outlet at a selected flow rate, collecting particulate matter introduced into the housing in a particulate trap situated in the housing, burning the particulate matter collected in the particulate trap to regenerate the particulate trap, sensing the back pressure in the housing, and varying the flow rate of the combustion product introduced into the housing during the burning step in proportion to the back pressure in the housing to prevent premature extinguishment of the ignited particulate matter in the trap.

* * * * *

UNITED STATES PATENT AND TRADEMARK OFFICE

CERTIFICATE OF CORRECTION

PATENT NO. : 4,651,524

DATED : March 24, 1987

INVENTOR(S) : John Brighton

It is certified that error appears in the above-identified patent and that said Letters Patent is hereby corrected as shown below:

At column 1, line 11, after "burner", please insert --during regeneration--;

At column 4, line 30, after "means", please insert --positioned upstream of the substrate or blow out the--;

At column 5, line 7, please delete "during ignition of the particulate matter";

At column 6, line 1, please delete "produce" and insert therefor --product--;

At column 10, line 5, please delete "enviornment" and insert therefor --environment--;

At column 13, line 27, please delete "100" and insert therefor --110--;

At column 15, line 4, please delete "particular" and insert therefor --particulate--;

UNITED STATES PATENT AND TRADEMARK OFFICE

CERTIFICATE OF CORRECTION

PATENT NO. : 4,651,524

DATED : March 24, 1987

INVENTOR(S) : John Brighton

It is certified that error appears in the above-identified patent and that said Letters Patent is hereby corrected as shown below:

At column 18, line 62, please delete "regnerate" and insert therefor --regenerate--; and At column 19, line 57, please delete "particular" and insert therefor --particulate--.

Signed and Sealed this

Sixth Day of October, 1987

*Attest:*

*Attesting Officer*

DONALD J. QUIGG

*Commissioner of Patents and Trademarks*